US010787632B2

(12) United States Patent
Cunningham et al.

(10) Patent No.: US 10,787,632 B2
(45) Date of Patent: Sep. 29, 2020

(54) CLEANING SOLVENT COMPOSITIONS EXHIBITING AZEOTROPE-LIKE BEHAVIOR AND THEIR USE

(71) Applicant: Zynon Technologies, LLC, New Britain, CT (US)

(72) Inventors: Wells Cunningham, New Hartford, CT (US); Elizabeth P. Norwood, Unionville, CT (US); Edward C. Mark, Jr., Hockessin, DE (US); Venesia L. Hurtubise, Hartford, CT (US)

(73) Assignee: ZYNON TECHNOLOGIES, LLC, New Britain, CT (US)

( * ) Notice: Subject to any disclaimer, the term of this patent is extended or adjusted under 35 U.S.C. 154(b) by 0 days.

(21) Appl. No.: 16/463,620

(22) PCT Filed: Nov. 30, 2017

(86) PCT No.: PCT/US2017/063870

§ 371 (c)(1),
(2) Date: May 23, 2019

(87) PCT Pub. No.: WO2018/102507

PCT Pub. Date: Jun. 7, 2018

(65) Prior Publication Data

US 2020/0181544 A1 Jun. 11, 2020

Related U.S. Application Data

(60) Provisional application No. 62/428,111, filed on Nov. 30, 2016.

(51) Int. Cl.
*C11D 7/50* (2006.01)
*C11D 3/43* (2006.01)

(52) U.S. Cl.
CPC ..... *C11D 7/505* (2013.01); *C11D 3/43* (2013.01); *C11D 7/5063* (2013.01)

(58) Field of Classification Search
CPC ..... C11D 7/5072
(Continued)

(56) References Cited

U.S. PATENT DOCUMENTS 3,776,693 A 12/1973 Smith et al.
4,724,096 A 2/1988 Figiel et al.
(Continued)

FOREIGN PATENT DOCUMENTS

WO 2012121749 A1 9/2012
WO 2014147311 A1 9/2014

OTHER PUBLICATIONS

"Phosphate Esters", Publication of Lakeland Laboratories Limited, Manchester, England, Ref: Lakeland Phos. Esters (4), Mar. 2000, 12 pages.

(Continued)

*Primary Examiner* — Gregory E Webb
(74) *Attorney, Agent, or Firm* — Cantor Colburn LLP

(57) ABSTRACT

A cleaning solvent composition comprises from about 70 to about 95.7 weight percent trans-dichloroethylene, from about 15 to about 3.8 weight percent heptafluorocyclopentane, and from about 15 to about 0.5 weight percent of methylperfluoroheptene ethers. The composition may comprise from about 88 to about 94.2 weight percent trans-dichloroethylene, from about 6 to about 3.8 weight percent heptafluorocyclopentane, and from about 6 to about 2 weight percent of methylperfluoroheptene ethers. A method for cleaning articles of soiling substances comprises contacting the articles with the solvent composition by any suitable means such as a spray delivered by a propellant gas,
(Continued)

or by contact with liquid and/or vapor solvent compositions, as in a conventional vapor degreaser apparatus.

13 Claims, 2 Drawing Sheets

(58) Field of Classification Search
USPC ..... 510/410
See application file for complete search history.

(56) References Cited

U.S. PATENT DOCUMENTS

| | | | |
|---|---|---|---|
| 5,334,325 | A | 8/1994 | Chaussee |
| 5,856,286 | A | 1/1999 | Nalewajek et al. |
| 5,908,822 | A | 6/1999 | Dishart |
| 6,053,952 | A | 4/2000 | Kaiser |
| 6,312,759 | B1 | 11/2001 | Yamada et al. |
| 6,350,395 | B1 | 2/2002 | Kuemin |
| 6,660,709 | B1 | 12/2003 | Dournel et al. |
| 8,410,039 | B2 | 4/2013 | Bartelt et al. |
| 8,637,443 | B2 | 1/2014 | Basu et al. |
| 2004/0117918 | A1 | 6/2004 | Scheper et al. |
| 2004/0259752 | A1 | 12/2004 | Degroot et al. |
| 2006/0052268 | A1 | 3/2006 | Artuphel et al. |
| 2006/0200914 | A1 | 9/2006 | Evers et al. |
| 2006/0217277 | A1 | 9/2006 | Lallier et al. |
| 2007/0010421 | A1 | 1/2007 | Wu |
| 2007/0203045 | A1 | 8/2007 | Schweitzer et al. |
| 2008/0139444 | A1 | 6/2008 | Bartelt |
| 2008/0274935 | A1 | 11/2008 | Dingess |
| 2009/0186799 | A1 | 7/2009 | Owens |
| 2012/0122996 | A1 | 5/2012 | Basu et al. |
| 2015/0329806 | A1 | 11/2015 | Robin et al. |
| 2016/0023974 | A1 | 1/2016 | Bonnet et al. |
| 2016/0326458 | A1 | 11/2016 | Smets et al. |
| 2016/0326468 | A1* | 11/2016 | Robin ..... C11D 3/245 |
| 2019/0119609 | A1* | 4/2019 | Shellef ..... C11D 7/5059 |

OTHER PUBLICATIONS

International Search Report for International Application No. PCT/US17/63870; International Filing Date Nov. 30, 2017; dated Jan. 30, 2018; 6 pages.

Written Opinion for International Application No. PCT/US17/63870; International Filing Date Nov. 30, 2017; dated Jan. 30, 2018; 5 pages.

* cited by examiner

CLEANING SOLVENT COMPOSITIONS EXHIBITING AZEOTROPE-LIKE BEHAVIOR AND THEIR USE

CROSS-REFERENCE TO RELATED APPLICATIONS

This application is a U.S. national stage application of International Application No. PCT/US2017/063870, which has an international filing date of 30 Nov. 2017, and which claims priority of U.S. provisional patent application Ser. No. 62/428,111 filed on Nov. 30, 2016 in the name of Wells Cunningham et al. and entitled "Cleaning Solvent Compositions Exhibiting Azeotrope-Like Behavior and Their Use".

BACKGROUND OF THE INVENTION

Field of the Invention

The present invention concerns solvent-based cleaning compositions of the type used in industrial processes for cleaning a wide variety of items including metals and plastics in the metal-working, electronics and other industries.

Description of Related Art

Solvent based cleaning compositions are used in industrial processes for cleaning a wide variety of soiling substances and residues (below sometimes referred to as "soils" or "soiling substances"). The electronics industry typically cleans fluxes, solder pastes, adhesives and coatings from a variety of devices before and after assembly of components. Such devices may comprise one or more of a wide range of materials comprising metal, ceramic and synthetic polymer (plastic) substrates and components. Metal working operations must remove lubricant oils and soaps, grinding media and greases from metal surfaces. Many of these soils are very difficult to strip from metal surfaces, especially with non-aqueous cleaners.

Of special interest are non-flammable blends of solvents that provide a cleaning solvent which can be used safely in aerosol packages, or as wiping fluids or in bulk cleaning tanks, for example, in vapor degreasing ("VDG") units. Typically, these cleaning solvents comprise halogenated compounds that are either non-flammable themselves or can be rendered non-flammable in a mixture with other halogenated compounds. For example, it is known to use chlorinated hydrocarbons, such as flammable trans-dichloroethylene (TDCE), as the high solvency component with fluorinated components that serve to render the cleaning solvent blend non-flammable. In addition, and especially for VDG applications, the cleaning solvent blend should be an azeotrope that is non-flammable so that the vapor is also non-flammable. Therefore, it is highly desirable that the azeotrope not significantly fractionate after distillation, condensation and re-mixing, as happens in a vapor degreaser. That is, the component ratios should be nearly the same in the boil sump as in the rinse sump in a VDG; or boil flask and receiver over the course of a full distillation.

The industry seeks to maximize the cleaning power of its products, often defined as the Kauri-Butanol index ("KB value"). To do this, the concentration of TDCE, or other high KB value components in the blend is made as high as is feasible. However, the solvent blend becomes more difficult to render non-flammable as the amount of the high KB value component in the composition is increased. A significant advance in the art was made by Dupont Corporation with the introduction of an azeotrope-like blend of 4% by weight of methylperfluoroheptene (MPHE) ethers, 0.8% Vertrel XF and 95.2% TDCE, offered as Vertrel Sion. This is currently the highest concentration of TDCE in a commercial product. However, the high TDCE concentration adversely affects flammability, that is, the Vertrel Sion solvent is more flammable than desired.

Robin et al. Patent Application Publication US 2016/0326468 A1, published on Nov. 10, 2016, discloses in paragraph [0010] a composition comprising from 0.1 to 8 weight percent methylperfluoroheptene ethers, from 90 to 99 weight percent trans-1,2-dichloroethylene and from 0.6 to 2 weight percent of a fluorocarbon selected from a very large group which includes heptafluorocyclopentane.

U.S. Pat. No. 8,410,039 to J. E. Bartelt et al. issued on Apr. 2, 2013 discloses the blends and uses of azeotropic formulations of methylperfluoroheptene ethers and trans-dichloroethylene. Co-solvents such as ethers and hydrocarbons, e.g., cyclopentane, are disclosed at column 7, lines 20-40.

U.S. Pat. No. 6,312,759 to T. Yamada et al. issued on Nov. 6, 2001 discloses blends of 95% or more heptafluorocyclopentane (HFCP) with many other solvents to be used as cleaning compositions or carrier fluids.

SUMMARY OF THE INVENTION

The present invention concerns low flammability cleaning solvent compositions exhibiting azeotrope-like behavior, for example in vapor degreaser operations, and the use of such cleaning solvents. The cleaning solvent compositions of the present invention are essentially non-fractionating upon distillation, which is important for both the efficient and safe operation of cleaning operations and safety of various solvent packages such as bulk solvent, and solvent aerosol, wipes, and pump sprays. The cleaning solvent compositions of the present invention comprise trans-dichloroethylene, heptafluorocyclopentane and methylperfluoroheptene ethers. The content of heptafluorocyclopentane is at least about 3.8 weight percent, preferably at least about 4 weight percent. It has been found that this feature provides a durable azeotrope-like characteristic to the composition.

The cleaning solvent compositions of the present invention generally comprise an effective amount of trans-1,2-dichloroethylene, for example, at least 50 weight percent of the composition, at least about 3.8 weight percent, for example, at least about 4 weight percent heptafluorocyclopentane, up to about 15 weight percent, and at least about 0.5 weight percent, for example, at least about 2 weight percent of methylperfluoroheptane ethers, up to about 15 weight percent.

More specifically, the cleaning solvent compositions of the present invention comprise from about 70 to about 95.7 weight percent trans-dichloroethylene, from about 15 to about 3.8 weight percent heptafluorocyclopentane, and from about 15 to about 0.5 weight percent of methylperfluoroheptene ethers. Certain embodiments of the present invention comprise from about 88 to about 94.2 weight percent trans-dichloroethylene, from about 6 to about 3.8 weight percent heptafluorocyclopentane, and from about 6 to about 2 weight percent of methylperfluoroheptene ethers. Other embodiments of the present invention comprise a cleaning solvent blend of about 91 to about 92.7%, e.g., about 92%, by weight trans-dichloroethylene, about 4.5 to about 3.8%, e.g., about 4%, by weight heptafluorocyclopentane, and about 4.5 to about 3.5%, e.g., about 4%, by weight methylperfluoroheptene ethers. Still other embodiments of the present invention provide a cleaning solvent blend of about 88 to about 92%, e.g., about 90%, by weight trans-dichloroethylene, about 6to about 4%, e.g., about 5%, by weight heptafluorocyclopentane, and about 6to about 4%, e.g., about 5%, by weight methylperfluoroheptene ethers.

Unless otherwise specifically stated, or clear from the context, all percentages of a given component, whether expressed as "%", "wt %", "weight %", "weight percent" or otherwise, are percent by weight of the component in the solvent composition, based on the total weight of the composition.

As used herein, the term "azeotrope-like" behavior or characteristics or language of similar import used with reference to the cleaning solvent blends of the present invention means that while the solvent blends may not exhibit perfect azeotropic characteristics (although some of the blends of the present invention may do so), the changes in composition after repeated distillation steps are small. Generally, the term "azeotrope-like composition" means a constant boiling, or substantially constant boiling liquid admixture of two or more substances that behaves under distillation as if it were a single substance. That is, the vapor produced by distillation of the liquid has substantially the same composition as the liquid from which it was distilled. Stated otherwise, there is no substantial composition change as the admixture is distilled. Further, an azeotrope-like composition may be characterized as a composition having a boiling point temperature of less than the boiling point of each pure component of the composition.

As a practical matter, it usually is acceptable if, for example, a change of not more than 20 wt %, preferably not more than 15 wt %, in the initially present quantity of each component of the blend is sustained over a protracted distillation (evaporation, condensation) period, e.g., seven days. To illustrate, refer to Example 3 below. The TDCE component is initially present in the amount of 92 wt % of the blend and after the seven-day distillation period is present in the rinse sump of the vapor degreaser in the amount of 91.7 wt %. Dividing 91.7 wt % by 92 wt % shows that 99.67 wt % of the component remains. The change in TDCE content is 0.33 wt % in the rinse sump. There was no change in the TDCE content of the boil sump. The same calculation for the HFCP component shown in Example 3 gives an average change of 3.4/4.0=0.85 or a decrease of 15% in the boil sump and an increase of 4.6/4.0=1.15 or 15 wt % in the rinse sump. Similar calculations for HFX-110 in Example 3 yield an average gain of HFX-110 in the boil sump of 15 wt % and an average loss in the rinse sump of 7.5 wt %. ("HFX-110" is a composition of methylperfluoroheptene ethers.) Changes in composition of the components in Example 3 ranged from 0 wt % (TDCE boil sump) to 15% gain or loss, as in the changes in HFCP and HFX-110 content from the original 4 wt % content of these components.

The solvent compositions of the present invention may contain other ingredients, such as surfactants, provided that the type and content of such other ingredients do not adversely affect the azeotrope-like characteristics or cleaning efficacy of the compositions. That is, the solvent compositions of the present invention may consist essentially of the specified ingredients and in some cases may consist of only the specified ingredients except for trace impurities found in commercial products. A propellant may be used to deliver the solvent compositions of the present invention and inasmuch as such propellants evaporate they do not affect the azeotrope-like characteristics or efficacy of the solvent compositions.

DETAILED DESCRIPTION OF THE INVENTION AND SPECIFIC EMBODIMENTS THEREOF

Figure 1:
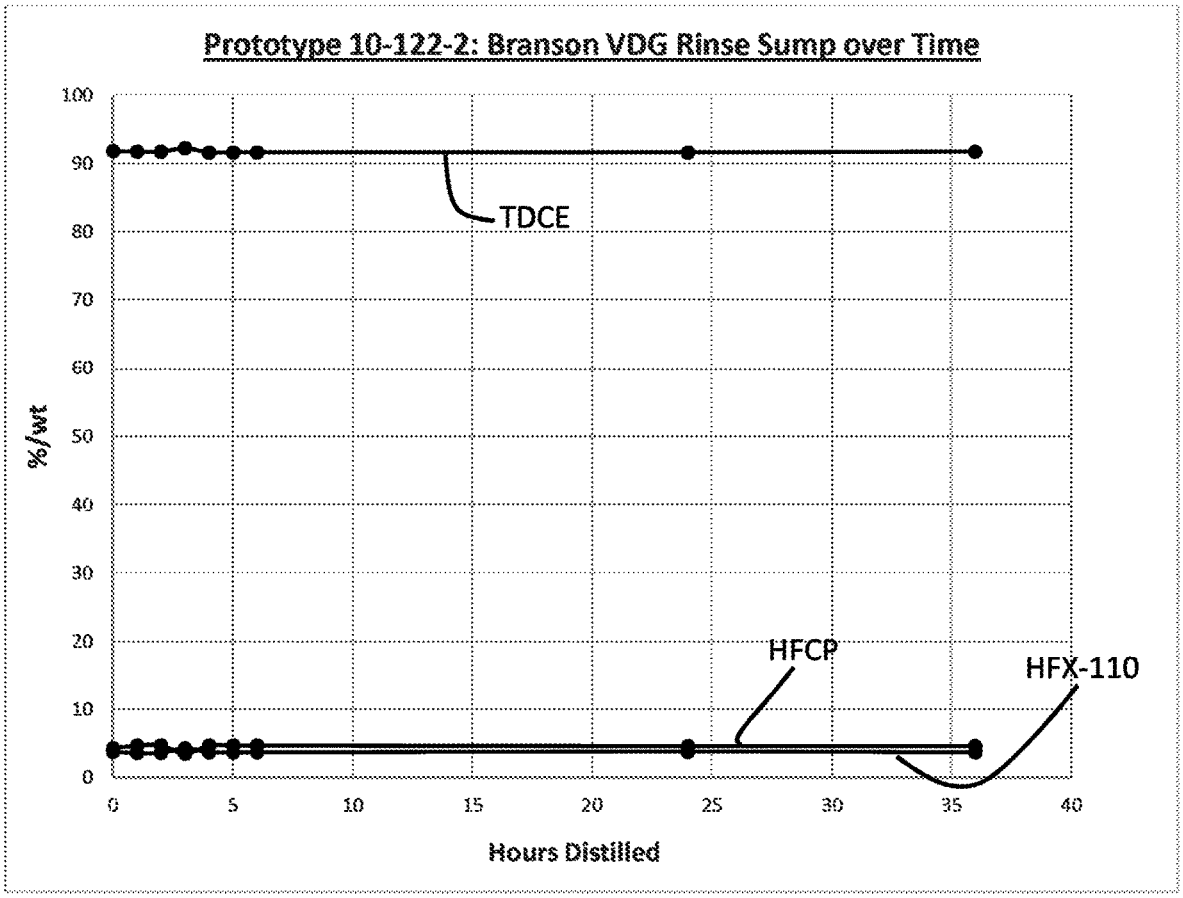
FIG. 1 is a graph plotting the change in composition of a cleaning solvent embodiment of the present invention measured in the rinse sump of a vapor degreaser against the time period of repeated distillation and condensation.

The following abbreviations, trademarks and trade names have the following meanings, whether used in the singular or plural form.

"TDCE". Trans-Dichloroethylene. Chemical Abstracts Number ("CAS #") 156-60-5.

"XF". The hydrofluorocarbon, 2,3-dihydrodecafluoropentane (HFC 43-10me) [Tradename Vertrel XF]. CAS #1384-95-42.

"HFX-110". Methylperfluoroheptene ethers; Tradename HFX-110. CAS #Proprietary.

"HFCP". 1,1,2,2,3,3,4-Heptafluorocyclopentane. Tradename Zeorora. CAS #15290-77-4.

"HFEs". Hydrofluoroethers such as HFE 7100, CAS #163702-08-7 and 163702-07-6.

"Vertrel® SFR". A blend of 67% trans-dichloroethylene, 18% 2,3-dihydrodecafluoropentane (HFC 43-10me); 12% heptafluorocyclopentane; 3% methanol. This material has a boiling point of 106° F. (41.1° C.) and is available from Chemours Corporation of Wilmington, Del.

"SION". A blend of 95.2% trans-dichloroethylene, 4.0% methylperfluoroheptene ethers (HFX-110) and 0.8% 2,3-dihydrodecafluoropentane (HFC 43-10me). This material has a boiling point of 121° F. (49.4° C.) and is available from Chemours Corporation of Wilmington, Del.

"CMS". A blend of 41.5% trans-dichloroethylene, 18% HFC 365mfc, 37% 2,3-dihydrodecafluoropentane (HFC 43-10me), 3.5% methanol. This material has a boiling point of 97° F. (36.1° C.) and is available from MicroCare Corporation of New Britain, Conn., the applicant herein.

"MCA". A blend of 62% trans-dichloroethylene, 38% 2,3-dihydrodecafluoropentane (HFC 43-10me). This material has a boiling point of 102° F. (38.9° C.) and is available from Chemours Corporation of Wilmington, Del.

"MEOH". Methyl alcohol.

"SDG". A blend of 83% trans-dichloroethylene, 7% 2,3-dihydrodecafluoropentane (HFC 43-10me); 10% hexafluorocyclopentane. Bp 109F. This material has a boiling point of 109° F. (42.8° C.) and is available from Chemours Corporation of Wilmington, Del.

"10-122-2" and "10-93-2". These are the designations applied respectively to two particularly effective embodiments of the present invention. It is a blend of 92% trans-dichloroethylene, 4% heptafluorocyclopentane and 4% methylperfluoroheptene ethers.

Standard Test Procedure. Trials were conducted in standard 2-sump vapor degreasers or in bench top simulation using a "dual bulb" apparatus made using a standard solvent still head with collection flask and sampling port on the boil flask. Samples from various locations and times are analyzed by gas chromatography using an Agilent Corporation DB-200 capillary column (trifluoropropyl methyl dimethyl siloxane stationary phase) and an FID detector. The following examples report the results of trials conducted pursuant to this Standard Procedure. The Vertrel Sion material, referred to below, is currently marketed under the tradename Opteon SF79.

COMPARATIVE EXAMPLE 1

Fractionation of Vertrel SFR in a Vapor Degreaser

Composition of Vertrel SFR Over Time in Branson B-452R Degreaser

| | % TDCE | | % HFCP | | % XF | | % MeOH | |
|---|---|---|---|---|---|---|---|---|
| | Virgin (Drum) | | | | | | | |
| | 67.7 | | 12.2 | | 17.3 | | 2.8 | |
| Time Distilled | Boil Sump | Rinse Sump | Boil Sump | Rinse Sump | Boil Sump | Rinse Sump | Boil Sump | Rinse Sump |
| 1 hour | 75.8 | 68 | 16.5 | 12.2 | 6.6 | 16.7 | 0.9 | 2.9 |
| 2 hours | 76.4 | 67.6 | 16.8 | 12.1 | 5.9 | 17.2 | 0.8 | 3 |
| 5 hours | 77.3 | 68.3 | 16.4 | 11.7 | 5.4 | 16.9 | 0.7 | 3 |
| 7 hours | 77.3 | 68.3 | 16.5 | 11.7 | 5.3 | 16.9 | 0.7 | 3 |
| 9 hours | 76.9 | 67.9 | 16.9 | 12.1 | 5.4 | 16.9 | 0.7 | 2.9 |
| 12 hours | 77.9 | 68.3 | 15.9 | 11.5 | 5.3 | 17.1 | 0.7 | 3 |
| 17 hours | 78.2 | 68.7 | 15.6 | 11.1 | 5.3 | 17.1 | 0.7 | 3.1 |

It can be seen that this blend of solvents, although remaining substantially azeotrope-like in behavior, changes its vapor composition quickly and dramatically. The ratios partition between the boil and rinse sump with the TDCE levels changing by more than 10% from the original values (67.7 weight % to 78.2 weight %).

COMPARATIVE EXAMPLE 2

Fractionation of Vertrel Sion

Composition of Vertrel Sion over time in a vapor degreaser

| | % TDCE | | % HFX-110 | | % XF | |
|---|---|---|---|---|---|---|
| | Virgin (Drum) | | | | | |
| | 95.1 | | 4.1 | | 0.8 | |
| Time Distilled | Boil Sump | Rinse Sump | Boil Sump | Rinse Sump | Boil Sump | Rinse Sump |
| 4.5 hours | 95.64 | 95.05 | 4.23 | 4.03 | 0.13 | 0.92 |
| 13 hours | 95.63 | 95.29 | 4.27 | 4.08 | 0.1 | 0.63 |
| 21.5 hours | 95.61 | 95.28 | 4.24 | 4.1 | 0.15 | 0.62 |
| 29.5 hours | 95.6 | 95.35 | 4.27 | 4.1 | 0.13 | 0.55 |

It can be seen that this product blend also changes ratio between the "boil" and "rinse" flasks. Most dramatically, the Vertrel XF which is present to improve the non-flammable characteristic of the blend, has been substantially depleted in the boil sump.

COMPARATIVE EXAMPLE 2A

Distillation in Laboratory Glassware of a Solvent Composition Containing an Initial Low Percentage (2.29 Weight Percent) of Heptafluorocyclopentane ("HFCP")

12-302-1

| | Time (hours) | % Trans | % HFCP | % MPHE | Boil Temp (° C.) | Total |
|---|---|---|---|---|---|---|
| Initial | 0 | 93.74 | 2.29 | 3.97 | — | 100 |
| Fraction 1 | 1 | 92.8 | 3.94 | 3.26 | 50 | 100 |
| Fraction 2 | 2 | 92.62 | 4.15 | 3.23 | 49 | 100 |
| Fraction 3 | 2.5 | 92.77 | 3.98 | 3.25 | 50.5 | 100 |
| Fraction 4 | 3.5 | 92.94 | 3.73 | 3.33 | 50.5 | 100 |
| Fraction 5 | 4.5 | 93.42 | 2.96 | 3.62 | 51 | 100 |
| Fraction 6 | 5.5 | 93.62 | 2.67 | 3.71 | 50 | 100 |
| Fraction 7 | 6.5 | 93.57 | 2.76 | 3.67 | 50 | 100 |
| Fraction 8 | 8 | 93.79 | 2.42 | 3.79 | 51.5 | 100 |
| Fraction 9 | 9 | 93.9 | 2.38 | 3.72 | 51 | 100 |
| Fraction 10 | 10 | 94.33 | 1.61 | 4.06 | 50 | 100 |
| Fraction 11 | 11.5 | 94.6 | 1.02 | 4.38 | 50 | 100 |
| Fraction 12 | 12.5 | 94.78 | 0.59 | 4.63 | 50 | 100 |

12-302-1. Distillation over a period of 11.5 hours shows that that HFCP composition was reduced from an initial amount of 2.29 weight percent to 1.02 weight percent. This is a reduction in HFCP content of the original composition of 1.02/2.29=44.5%. At 12.5 hours of distillation the reduction in HFCP content is 25.8%. At various times of distillation both the HFCP and the methylperfluoroheptane ethers ("MPHE") contents fluctuated significantly showing that the low HFCP composition does not possess azeotrope-like characteristics over only 12.5 hours of distillation, even though the trans-dichloroethylene content remained fairly stable.

COMPARATIVE EXAMPLE 2B

Distillation in Laboratory Glassware of a Solvent Composition Containing an Initial Low Percentage (3.03 Weight Percent) of Heptafluorocyclopentane ("HFCP")

12-307-1

| | Time (hours) | % Trans | % HFCP | % MPHE | Boil Temp (° C.) | Total |
|---|---|---|---|---|---|---|
| Initial | 0 | 93.01 | 3.03 | 3.96 | — | 100 |
| Fraction 1 | 1 | 91.03 | 6.22 | 2.75 | 50.5 | 100 |
| Fraction 2 | 2 | 91.12 | 6.08 | 2.8 | 50.5 | 100 |
| Fraction 3 | 3 | 91.83 | 5 | 3.17 | 50.5 | 100 |
| Fraction 4 | 4 | 92.04 | 4.69 | 3.27 | 50.5 | 100 |
| Fraction 5 | 5 | 92.7 | 3.76 | 3.54 | 51.5 | 100 |
| Fraction 6 | 6 | 92.99 | 3.33 | 3.68 | 51 | 100 |
| Fraction 7 | 7 | 93.31 | 2.83 | 3.86 | 50.5 | 100 |
| Fraction 8 | 8 | 93.65 | 2.28 | 4.07 | 52 | 100 |
| Fraction 9 | 10 | 94.01 | 1.08 | 4.91 | 52 | 100 |

12-307-1. Example 2B shows that after two hours of distillation an initial content of 3.03 weight percent HFCP increased to 6.08 weight percent, an increase of 6.08/3.03 or 100 percent. The HFCP content diminished with additional distillation. After 10 hours of distillation the HFCP content was 1.08 weight percent, a reduction of 1.08/3.03=36 percent. This low initial HFCP content blend did not demonstrate azeotrope-like characteristics.

COMPARATIVE EXAMPLE 2C

Distillation in Laboratory Glassware of a Solvent Composition Containing an Initial Low Percentage (3.51 Weight Percent) of Heptafluorocyclopentane ("HFCP")

| 12-307-2 | | | | | | |
|---|---|---|---|---|---|---|
| | Time (hours) | % Trans | % HFCP | % MPHE | Boil Temp (° C.) | Total |
| Initial | 0 | 92.49 | 3.51 | 4 | — | 100 |
| Fraction 1 | 1 | 91.41 | 5.48 | 3.11 | 49.5 | 100 |
| Fraction 2 | 2.5 | 90.63 | 6.71 | 2.66 | 49.5 | 100 |
| Fraction 3 | 3.5 | 91.43 | 5.46 | 3.11 | 50 | 100 |
| Fraction 4 | 5 | 91.68 | 5.16 | 3.16 | 50 | 100 |
| Fraction 5 | 6 | 91.36 | 5.6 | 3.04 | 50 | 100 |
| Fraction 6 | 7.25 | 92.04 | 4.55 | 3.41 | 50 | 100 |
| Fraction 7 | 8.25 | 92.88 | 3.19 | 3.93 | 53 | 100 |
| Fraction 8 | 9.25 | 93.43 | 2.39 | 4.18 | 53 | 100 |
| Fraction 9 | 11.25 | 93.56 | 2.19 | 4.25 | 52.5 | 100 |
| Fraction 10 | 12.75 | 93.94 | 1.46 | 4.6 | 50 | 100 |

12-307-2. A solvent composition with an initial HFCP content of 3.51 weight percent showed a significant increase in HCFP after only one hour of distillation, to 5.48 weight percent, an increase of 5.48/3.51 or 59 percent. At 2.5 hours of distillation the HFCP content had increased to 6.71 weight percent, an increase of 6.71/3.51 or 91 percent. The MPHE content was reduced at these times of distillation. By 7.25 hours of distillation the HFCP content had reduced to 4.55 weight percent and the MPHE content had recovered to 3.41 weight percent. At 12.75 hours of distillation, the HFCP content was reduced to 1.46 weight percent. Like comparative examples 2A and 2B, comparative example 2C shows that a low initial HFCP content does not provide azeotrope-like characteristics even after only 12.75 hours of distillation.

EXAMPLE 3

Formulation of an Embodiment (Designated 10-122-2) of the Present Invention

Part A—Distillation in a Vapor Degreaser

| Composition of Prototype 10-122-2 Over Time in Branson B-452R Degreaser | | | | | | |
|---|---|---|---|---|---|---|
| | % TDCE | | % HFCP Virgin (Drum) | | % HFX-110 | |
| | 92.0 | | 4.0 | | 4.0 | |
| Time Distilled | Boil Sump | Rinse Sump | Boil Sump | Rinse Sump | Boil Sump | Rinse Sump |
| 1 hour | 92.1 | 91.7 | 3.5 | 4.7 | 4.3 | 3.6 |
| 2 hours | 92.2 | 91.7 | 3.5 | 4.7 | 4.3 | 3.6 |
| 5 hours | 92 | 91.6 | 3.5 | 4.7 | 4.5 | 3.7 |
| 6 hours | 92 | 91.6 | 3.5 | 4.7 | 4.5 | 3.7 |
| 24 hours | 92 | 91.6 | 3.3 | 4.6 | 4.7 | 3.8 |
| 36 hours | 92.1 | 91.7 | 3.3 | 4.6 | 4.6 | 3.7 |
| 4 days | 92.1 | 91.8 | 3.2 | 4.5 | 4.7 | 3.7 |
| 5 days | 92 | 91.7 | 3.2 | 4.5 | 4.7 | 3.8 |
| 6 days | 91.9 | 91.7 | 3.3 | 4.5 | 4.8 | 3.8 |

-continued

| Composition of Prototype 10-122-2 Over Time in Branson B-452R Degreaser | | | | | | |
|---|---|---|---|---|---|---|
| | % TDCE | | % HFCP Virgin (Drum) | | % HFX-110 | |
| | 92.0 | | 4.0 | | 4.0 | |
| Time Distilled | Boil Sump | Rinse Sump | Boil Sump | Rinse Sump | Boil Sump | Rinse Sump |
| 7 days | 91.9 | 91.6 | 3.3 | 4.5 | 4.8 | 3.9 |
| Averages | 92.0 | 91.7 | 3.4 | 4.6 | 4.6 | 3.7 |

As shown by Part A of Example 3, the present invention quickly redistributes ratios to a small degree, changing the composition only slightly over a week of distillation. The cleaning power and non-flammable behavior is maintained in all locations of the vapor degreaser.

Part B—Distillation in Laboratory Glassware Simulating a Vapor Degreaser

| Prototype 10-122-2 Vapor Degreaser Simulation | | | |
|---|---|---|---|
| Total Time Distilled (hours) | % TDCE | % HFCP | % HFX-110 |
| 0 | 92.0 | 4.0 | 4.0 |
| 1 | 91.9 | 4.9 | 3.2 |
| 2 | 92.2 | 4.4 | 3.3 |
| 3 | 92.3 | 4.3 | 3.4 |
| 4 | 92.3 | 4.2 | 3.5 |
| 5 | 92.3 | 4.1 | 3.6 |

The results of Part B of Example 3, in which distillation was carried out in laboratory glassware simulating operation in a vapor degreaser, shows excellent results. Over 5 hours of distillation resulted in only a very small change.

Figure 2:
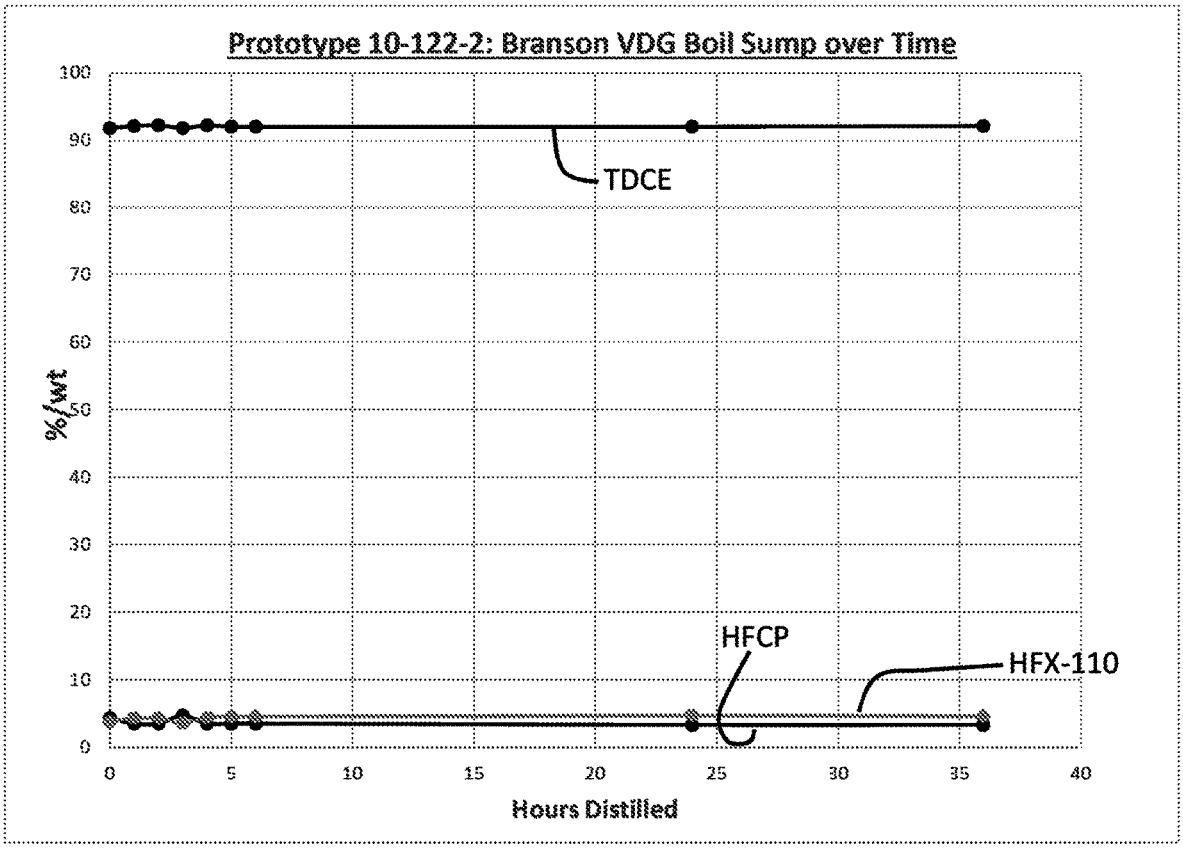
FIG. 2 is a graph identical to that of FIG. 1 except that the change in composition is measured in the boil sump of the vapor degreaser.

FIGS. 1 and 2 are graphs plotting on the vertical axis the weight percent of each component in the cleaning solvent embodiment of the present invention designated 10-122-2, and on the horizontal axis the duration in hours of distillation and condensation in a Branson VDG. As noted above, the composition of 10-122-2 is 92 wt percent trans-dichloroethylene, 4 wt % heptafluorocyclopentane, and 4 wt % methylperfluoroheptene ethers. FIG. 1 shows the measured quantities in the rinse sump of the Branson B-452R vapor degreaser and FIG. 2 shows the measured composition in the boil sump of the Branson B-452 vapor degreaser. As shown in the Figures, the change in composition after about 36 hours of distillation and condensation is minimal.

As the above examples show, azeotrope-like characteristics of solvent compositions comprising trans-1,2-dichloroethylene (TDCE), heptafluorocyclopentane (HFCP) and methylperfluoroheptene ethers (MEPH or HFX-110) require more than about 3.5 weight percent HFCP, preferably at least about 3.8 weight percent HFCP, more preferably at least about 4 weight percent, in the initial composition in order to maintain azeotrope-like characteristics for a significant time of use.

EXAMPLE 4

Range of Ratios Showing Azeotrope-Like Behavior

| | Comparative Vertrel Sion (95% TDCE/ 4.2% HFX-110/ 0.8% XF) | Comparative 10-93-2 (95% TDCE/ 2% HFCP/ 3% HFX-110) | Embodiment of the Invention 10-122-2 (92% TDCE/ 4% HFCP/ 4% HFX-110) |
|---|---|---|---|
| Boiling Point of Lowest-Boiling Component (TDCE) | 118° F. | 118° F. | 118° F. |
| Theoretical Boiling Point (Based on Calculation) | 122.7° F. | 122.5° F. | 125° F. |
| Boiling Point Measured with 9F-86 Hg thermometer | 117.8° F. | 117-117.5° F. | 117° F. |

Comparative example 10-93-2, with an initial content of 2 weight percent heptafluorocyclopentane shows an actual boiling point lower than that of the lowest boiling component, and therefore lower than that of any pure component of the blend. However, as shown by the above comparative examples, the low initial content (2 percent by weight) of heptafluorocyclopentane causes a loss of azeotrope-like behavior after a period of distillation.

The boiling points across the tabulated ranges of composition remain below any of the individual solvents demonstrating azeotrope-like behavior.

EXAMPLE 5

The present invention stays non-flammable in all compartments of a vapor degreater versus the fractionated boil sump of Vertrel Sion that becomes flammable.

EXAMPLE 6

The non-flammable aerosol version of the present invention was tested for flammability versus a Vertrel Sion aerosol. The latter failed the flame extension test at 36 inches whereas the composition in accordance with an embodiment of the present invention passed.

| GHS Flame Extension Test | 6 inches | 36 inches |
|---|---|---|
| 80% 10-122-2/20% HFC134a propellant | PASS | PASS |
| 80% Vertrel Sion/20% HFC134a propellant | PASS | FAIL |

The improved non-flammability of the invention over the commercial product is demonstrated.

While the invention has been described in detail with reference to specific embodiments, it will be appreciated that numerous variations may be made to the described embodiment, which variations nonetheless lie within the scope of the present invention.

What is claimed is:

1. A solvent composition exhibiting azeotrope-like properties and comprising:

from about 70 to about 95.7 weight percent trans-dichloroethylene;

from about 15 to about 3.8 weight percent heptafluorocyclopentane; and from about 15 to about 0.5 weight percent methylperfluoroheptene ethers.

2. The solvent composition of claim 1 comprising:

from about 88 to about 94.2 weight percent trans-dichloroethylene;

from about 6 to about 3.8 weight percent heptafluorocyclopentane; and from about 6 to about 2 weight percent methylperfluoroheptene ethers.

3. The composition of claim 1 comprising:

from about 91 to about 92.7 weight percent trans-dichloroethylene;

from about 4.5 to about 3.8 weight percent heptafluorocyclopentane; and from about 4.5 to about 3.5 weight percent methylperfluoroheptene ethers.

4. The composition of claim 1 comprising:

from about 70 to about 95.5 weight percent trans-dichloroethylene;

from about 15 to about 4 weight percent heptafluorocyclopentane; and from about 15 to about 0.5 weight percent methylperfluoroheptene ethers.

5. The composition of claim 1 comprising:

about 92 weight percent trans-dichloroethylene;

about 4 weight percent heptafluorocyclopentane; and about 4 weight percent methylperfluoroheptene ethers.

6. The composition of claim 1 comprising:

from about 88 to about 92 weight percent trans-dichloroethylene;

from about 6 to about 4 weight percent heptafluorocyclopentane; and from about 6 to about 4 weight percent methylperfluoroheptene ethers.

7. The composition of claim 1 comprising:

about 90 weight percent trans-dichloroethylene;

about 5 weight percent heptafluorocyclopentane; and about 5 weight percent methylperfluoroheptene ethers.

8. A method for cleaning soiling substances from metal, ceramic and synthetic polymer articles comprising:

contacting one or more of the articles with a solvent composition having azeotrope-like properties, the composition comprising:

from about 70 to about 95.7 weight percent trans-dichloroethylene;

from about 15 to about 3.8 weight percent heptafluorocyclopentane;

from about 15 to about 0.5 weight percent methylperfluoroheptene ethers; and removing the composition from the one or more articles.

9. The method of claim 8 wherein the composition comprises:

from about 88 to about 94.2 weight percent trans-dichloroethylene;

from about 6 to about 3.8 weight percent heptafluorocyclopentane; and from about 6 to about 2 weight percent methylperfluoroheptene ethers.

10. The method of claim 8 wherein the composition comprises:

from about 91 to about 92.7 weight percent trans-dichloroethylene;

from about 4.5 to about 3.8 weight percent heptafluorocyclopentane; and from about 4.5 to about 3.5 weight percent methylperfluoroheptene ethers.

11. The method of claim 8 wherein the composition comprises:

from about 70 to about 95.5 weight percent trans-dichloroethylene;

from about 15 to about 4 weight percent heptafluorocyclopentane; and from about 15 to about 0.5 weight percent methylperfluoroheptene ethers.

12. The method of claim 8 wherein the composition comprises:

about 92 weight percent trans-dichloroethylene;

about 4 weight percent heptafluorocyclopentane; and about 4 weight percent methylperfluoroheptene ethers.

13. The method of claim 8 wherein the composition comprises:

from about 88 to about 92 weight percent trans-dichloroethylene;

from about 6 to about 4 weight percent heptafluorocyclopentane; and from about 6 to about 4 weight percent methylperfluoroheptene ethers.

* * * * *